United States Patent [19]

Bloom

[11] 4,406,021

[45] Sep. 27, 1983

[54] UNIFORM CAP WITH ADJUSTABLE SWEATBAND

[76] Inventor: Bernard Bloom, C/O Midway Cap. Co., 2301 W. St. Paul Ave., Chicago, Ill. 60647

[21] Appl. No.: 347,488

[22] Filed: Feb. 10, 1982

Related U.S. Application Data

[63] Continuation-in-part of Ser. No. 236,294, Feb. 19, 1981, abandoned.

[51] Int. Cl.[3] ..... A42B 5/00

[52] U.S. Cl. ..... 2/181

[58] Field of Search ..... 2/181, 197, DIG. 11, 2/198, 182.1, 182.2

[56] References Cited

U.S. PATENT DOCUMENTS 2,742,646 4/1956 Berg ..... 2/197

3,513,481 5/1970 Nickerson ..... 2/197

4,274,157 6/1981 Boden ..... 2/197

*Primary Examiner*—Doris L. Troutman

*Attorney, Agent, or Firm*—Wood, Dalton, Phillips, Mason & Rowe

[57] ABSTRACT

A uniform cap having an adjustable sweatband to provide an inner diameter of variable size for use with a fixed size frame. The ends of the sweatband are joined by a connector including four headed studs disposed at one end of the band which engage various ones of a plurality of holes disposed at the opposite end of the band. The adjustable sweatband is slidably suspended from a pair of guides secured to the inner surface of the frame on opposite sides thereof. The guides are reversible so that the adjustable sweatband may be used with a frame either 2 inches of 2¼ inches in width. The front portion of the sweatband is gradually increased in width to prevent the band from sliding above the lower edge of the frame when the uniform cap is worn.

13 Claims, 9 Drawing Figures

Fig. 1
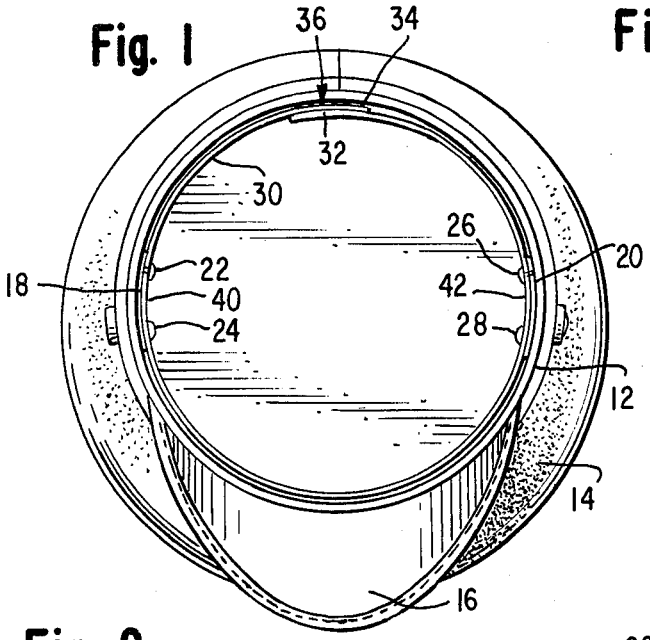
Fig. 4
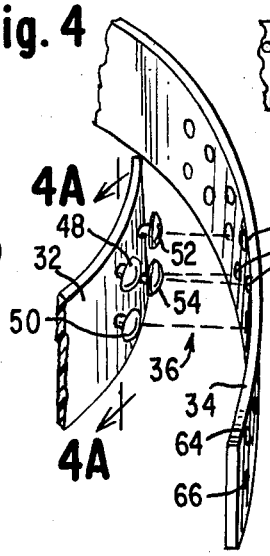
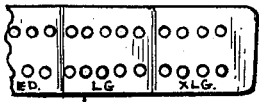
68 Fig. 4B
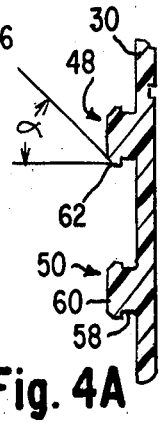
Fig. 4A
Fig. 2
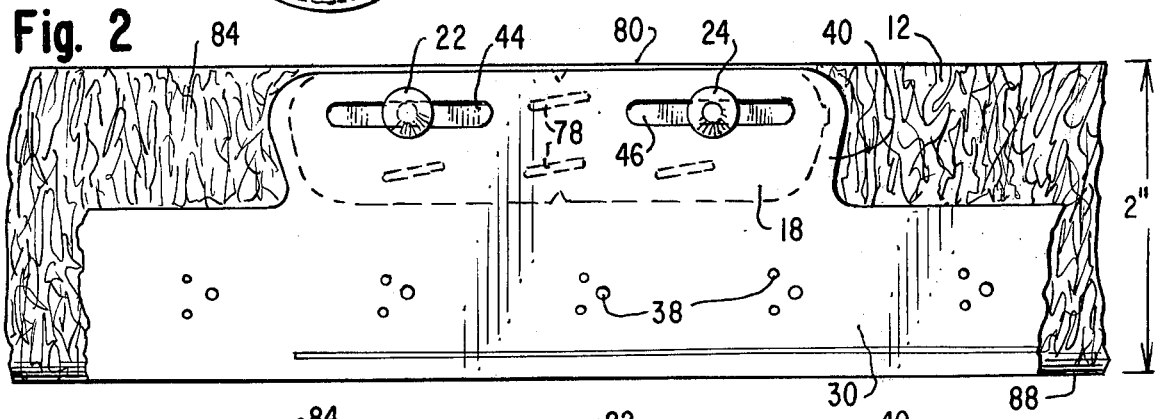
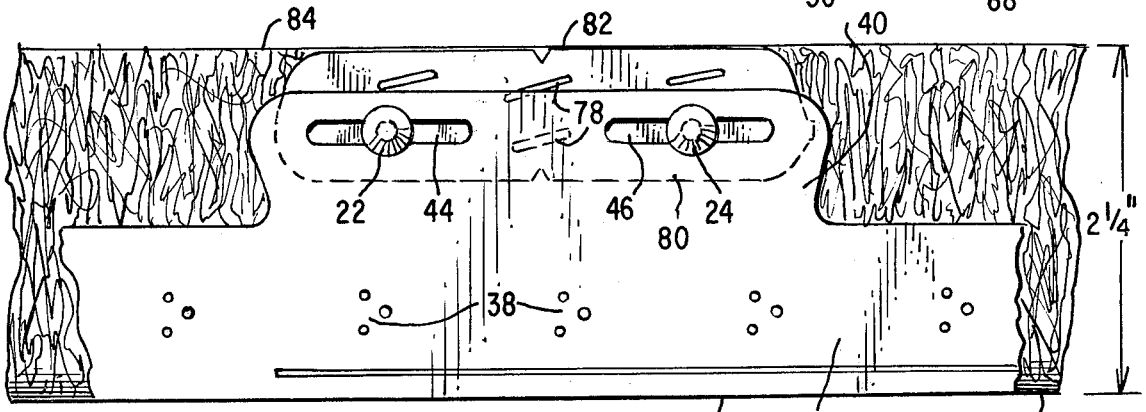
Fig. 3
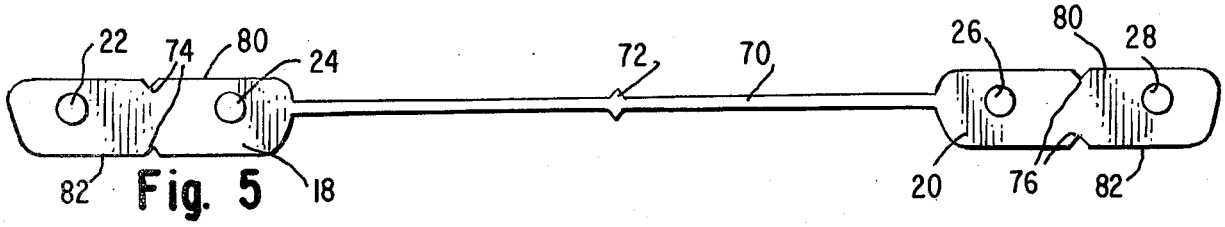
Fig. 5

Fig. 6
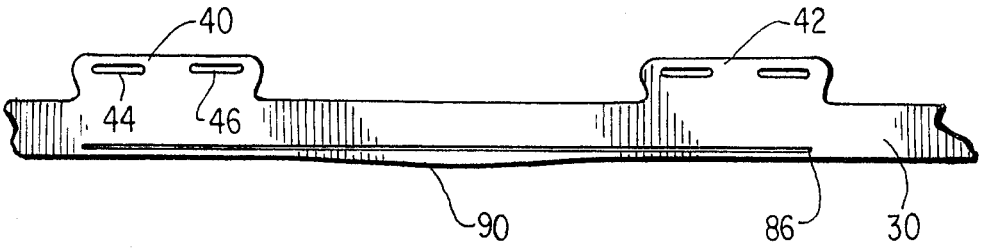
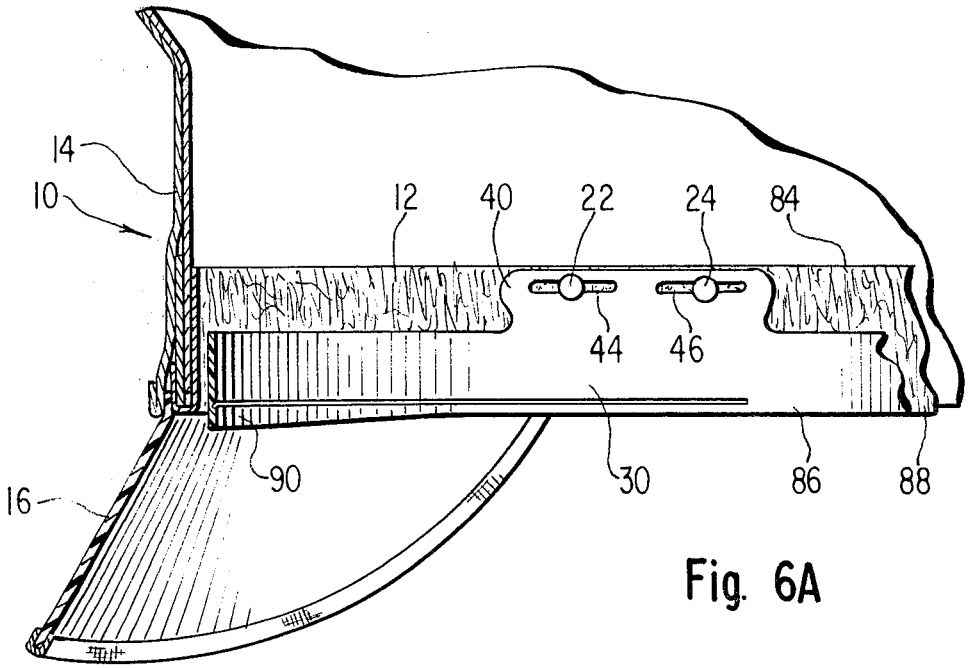
Fig. 6A

UNIFORM CAP WITH ADJUSTABLE SWEATBAND

BACKGROUND OF THE INVENTION

This application is a continuation-in-part application of Ser. No. 236,294 now abandon filed Feb. 19, 1981.

This invention relates to a uniform cap having an adjustable sweatband to provide an inner diameter of variable size for use with a fixed size frame. The sweatband is slidably suspended from a pair of guides which are reversible to accommodate a frame having either a 2" width or a 2¼" width.

Known uniform caps typically include a fixed size frame, having a sweatband secured to the inner surface thereof. In order to accommodate various head sizes, numerous frames, each having a different fixed diameter, must be made which can be very costly. The sweatband typically is longer than the inner periphery of the frame and has its ends overlapped. Problems with fit also arise if a head size falls in between the standard cap or frame sizes.

The standard frame width for a uniform cap is 2"; however, some caps are constructed having a 2¼" frame width. Possibly 10% of the uniform caps have a smaller, non-standard width.

Further, sweatbands are typically secured to the cap frame permanently as by stitching or the like which increases the difficulty of installation and is very time-consuming.

SUMMARY OF THE INVENTION

In accordance with the present invention, the disadvantages of prior uniform cap constructions have been overcome.

The uniform cap includes an adjustable sweatband to provide an inner diameter of variable size for use with a fixed size frame. The ends of the sweatband are joined by a connector including headed studs disposed at one end which engage various ones of a plurality of holes disposed at the opposite end of the sweatband. The holes and studs are spaced apart to provide a number of incremental size adjustments. The diameter of the sweatband is increased or decreased to provide a properly fitting cap by inserting the studs into the appropriate holes.

The adjustable sweatband is slidably suspended from a pair of guides which are secured to the inner surface of the frame on opposite sides thereof. The sweatband includes a pair of tabs, each tab having a pair of slots therein for engagement with a respective pair of headed studs protruding inwardly from the guides. Installation of the sweatband is easily accomplished by snapping the slots over the headed guide studs.

The guides are reversible so that the adjustable sweatband may be used with a frame having either a 2" width or a 2¼" width. The guides are also trapezoidal in shape having an upper edge of greater length than the lower edge so that one can readily discern which edge should be up for frames of various widths.

The uniform cap floats on the adjustable sweatband which provides a cushioning effect such that the wearer's head never presses against the frame resulting in maximum comfort. In order to prevent the sweatband from sliding above the lower edge of the frame when the cap is worn, the front portion of the band is gradually increased in width.

Further advantages of the invention will be readily apparent from the following specification and from the drawings in which:

FIG. 1 is an inside view of a uniform cap having an adjustable sweatband installed therein;

FIG. 2 is a partial perspective of an adjustable sweatband suspended from a guide which is secured to a frame 2" in width;

FIG. 3 is a partial perspective of an adjustable sweatband suspended from a guide which is secured to a frame 2¼" in width;

FIG. 4 is an exploded view of the sweatband connector;

FIG. 4A is a cross-sectional view of the headed studs of the connector taken along line 4A—4A of FIG. 4;

FIG. 4B is a partial perspective of the holes of the connector;

FIG. 5 illustrates the guides before installation;

FIG. 6 is a partial perspective of the adjustable sweatband having a gradually increased width at the front portion thereof;

FIG. 6A is a partial perspective of a uniform cap having the sweatband of FIG. 6 installed therein.

DESCRIPTION OF THE PREFERRED EMBODIMENT

The features of the present invention are illustrated as embodied in a conventional uniform cap, generally designated 10, in FIG. 1. The cap includes an annular band or frame 12, a cover 14 and a visor 16. A pair of guides 18 and 20 are secured to the inner surface of the frame 12 on opposite sides thereof. The guides 18 and 20 include a pair of headed studs 22, 24 and 26, 28 which project inwardly and from which an adjustable sweatband 30 is suspended. The opposite ends 32 and 34 of the sweatband 30 are joined by a connector, generally designated 36, to form a continuous band around the inner surface of the frame 12. The connector 36 is adjustable to vary the inner diameter of the sweatband to accommodate various head sizes.

The adjustable sweatband, shown in greater detail in FIGS. 2–4, is made of a molded plastic, engraved with a design 38 to give an appearance of leather. A pair of elongated tabs 40 and 42 project upwardly from the sweatband 30 for engagement with the guides 18 and 20 respectively. Only tab 40 and guide 18 are shown in FIG. 2 and 3, tab 42 and guide 20 being identical. The tab 40 includes a pair of elongated slots 44 and 46 which snap over the respective guide studs 22 and 24 so that the sweatband 30 is suspended therefrom. The slots 44 and 46 allow lateral movement of the sweatband 30 to accommodate various size adjustments therein.

The connector 36 joining the sweatband ends 32 and 34 is shown in detail in FIG. 4. The end 32 of the sweatband 30 includes four headed studs 48, 50, 52 and 54 aligned in longitudinal pairs. The headed studs project outwardly for engagement with a plurality of holes 56 disposed in the opposite end 34 of the sweatband. As shown in FIG. 4A, the studs 48 and 50 have a cylindrical base 58 and a beaded head or protuberance 60 at the end thereof. The protuberance 60 has a beveled edge 62 for easy insertion of the studs into the holes 56. The studs are relatively flat, being only 1/10" thick so as not to protrude too far and cause pressure on the head. Although four headed studs are shown, one longitudinal pair may be eliminated, the remaining pair of studs being sufficient to securely join the sweatband ends together.

The holes 56 are longitudinally aligned in two parallel rows 64 and 66 extend around the periphery of the sweatband at end 34. The centers of each adjacent pair of holes are separated by a distance d as are the centers of the adjacent studs 48 and 52; 50 and 54, where two longitudinal pairs of studs are employed. By inserting studs 48, 50, 52 and 54 in various ones of adjacent longitudinal pairs of holes the diameter of the sweatband may be increased or decreased in size adjustment increments equal to d. Depending upon the size of the holes, studs and the spacing d, a greater number of cap sizes may be provided than would be practical if a different sweatband having a fixed diameter for each size were to be made. The number of intermediate size adjustments provided by holes 56 can thus accommodate head sizes which fall between the standard cap or frame sizes to thereby provide a better fitting cap. In the present embodiment a spacing of d=¼" has been used to provide corresponding size adjustment increments of ¼ of an inch. It is noted that the connector 36 may be made of Velcro material or the like to provide a sweatband infinitely adjustable.

Although the sweatband of the present invention may be used with a single size frame to accommodate head sizes ranging from small to extra-large, preferably two sweatbands are used, one for small and medium frames, the other for larger and extra-large frames so that the frame will not look out of proportion to the sweatband. Each size sweatband includes a number of intermediate size adjustments according to the number of apertures therein. As seen in FIG. 4B for a larger size sweatband having five pairs of longitudinally aligned holes 68 for engagement with the headed studs on end 32 of the band, four different intermediate size adjustments are provided.

The guides 18 and 20, as shown in FIG. 5, are made of plastic, molded as one integral piece and joined by a connecting strip 70. A diamond-shaped notch 72 is formed on the connecting strip and a pair of inverted notches 74 and 76 are formed on each of the guides 18 and 20 respectively. The notches 72, 74 and 76 are aligned with respectively marked notches on the frame 12 during installation so that the guides will be properly positioned. Once the guides 18 and 20 are aligned, they are secured to the frame 12 by means of staples 78 or the like. After the guides are installed, the connecting strip is severed, leaving the guides in place.

The guides 18 and 20 are reversible so that the adjustable sweatband may be used with a frame having either a 2" width or a 2¼" width. The guide studs 22 and 24; 26 and 28 are disposed in a row parallel to the upper and lower edges 80 and 82 of the guides 18 and 20. The studs are positioned off center, being ¼" closer to the upper edge 80 than the lower edge 82 so that the guides may be reversed, accommodating both a 2" and 2¼" frame width.

For a frame, 2" in width as shown in FIG. 2, the guides are positioned so that the upper edge 80 is aligned with the upper edge 84 of the frame 12. When the sweatband is suspended from the guide studs 22, 24, 26 and 28, the lower edge 86 of the band is aligned with the lower edge 88 of the frame 12.

For a frame, 2¼" in width as shown in FIG. 3, the guides are reversed so that the lower edge 82 is aligned with the upper edge 84 of the frame 12. When the sweatband is suspended from the guide studs 22, 24, 26 and 28, the lower edge 86 of the band is aligned with the lower edge 88 of the 2¼" frame 12.

So that one can readily discern which edge of the guides should be aligned with the upper edge 84 of frame 12, the guides are made trapezoidal in shape having an upper edge 80 which is longer than the lower edge 82. For the 2" width frame the longer edge 80 is aligned with the upper edge 84 of the frame, whereas the shorter edge 82 is aligned with the upper edge 84 for a frame, 2¼ inches in width.

The adjustable sweatband 30 provides a cushioning effect wherein the wearer's head never presses against the frame 12, the uniform cap 10 floating on the band to result in maximum comfort. In order to prevent the sweatband 30 from sliding above the visor 16 when the uniform cap is worn, the front portion 90 of the band adjacent to that portion of the frame 12 to which the visor is secured may be formed with a gradually increasing width. The lower edge 86 of the sweatband 30 from each of the tabs 40 and 42 to the center of the band is gradually tapered downward to provide a maximum increase in width of ¼". When the sweatband is suspended from the guide studs 22, 24, 26 and 28, the lower edge 86 of the band from the ends 32 and 34 to the respective tabs 40 and 42 is aligned with the lower edge 88 of the frame 12. The lower edge of the front portion 90 from the tabs 40 and 42 toward the center of the band gradually extends a maximum of ¼" below that portion of the frame 12 adjacent to the visor 16.

I claim:

1. In a uniform cap having a continuous frame extending about the cap, an improved size adjustment means for use with fixed size frames of various widths, said means being adjustable to provide an inner diameter of variable size comprising:

an adjustable sweatband having opposite ends;

means for connecting the opposite ends of said sweatband to form a continuous band around the inner surface of said frame, said connecting means being adjustable to provide an inner diameter of variable size; and a pair of guide means secured to the inner surface of said frame on opposite sides thereof for slidably suspending said adjustable sweatband therefrom, said guide means being reversible to accommodate frames having different widths such that the sweatband when suspended from said guide means has a lower edge aligned with the lower edge of each of said frames of differing widths.

2. The uniform cap of claim 1 with a frame having either a first width or a second width, wherein said guide means has an upper and lower edge, said guide means being secured to a frame having said first width such that the upper edge of the guide is aligned with the upper edge of said frame, said guide means being reversibly mounted and secured to a frame having said second width such that the lower edge of the guide is aligned with the upper edge of said frame.

3. The uniform cap of claim 2 with a frame having a first width equal to 2" or a second width equal to 2¼" wherein each of said guide means includes at least one headed stud protruding inwardly and positioned at a distance from the bottom edge of said guide, said distance being ¼" greater than the distance of the studs from the upper edge of said guide and said sweatband including an elongated slot which snaps over said studs for slidably suspending said sweatband therefrom.

4. The uniform cap of claim 2 wherein each of said guide means is trapezoidal in shape having an upper edge of greater length than the length of said lower edge.

5. In a uniform cap having a continuous frame extending about the cap, an improved size adjustment means for use with a fixed size frame and adjustable to provide an inner diameter of variable size comprising:

a pair of guide means secured to the inner surface of said frame on opposite sides thereof, said guide means being made of molded plastic and joined by a connecting strip which is severable after said guide means are secured to the frame;

an adjustable sweatband slidably suspended from said guide means, said sweatband having opposite ends; and means for connecting the opposite ends of said sweatband to form a continuous band around the inner surface of said frame, said connecting means being adjustable to provide an inner diameter of variable size.

6. The uniform cap of claim 5 wherein each of said guide means and said connecting strip include an installation marked for accurately aligning said guide means with said frame.

7. In a uniform cap having a continuous frame extending about the cap, an improved size adjustment means for use with a fixed size frame and adjustable to provide an inner diameter of variable size comprising:

a pair of guide means secured to the inner surface of said frame on opposite sides thereof;

an adjustable sweatband slidably suspended from said guide means, said sweatband having opposite ends and a front portion disposed therebetween, said front portion having a greater width than the width of the sweatband at the ends; and means for connecting the opposite ends of said sweatband to form a continuous band around the inner surface of said frame, said connecting means being adjustable to provide an inner diameter of variable size.

8. The uniform cap of claim 7 wherein the width of the front portion increases on a gradual basis toward the center of the sweatband.

9. The uniform cap of claim 8 wherein the maximum increase in width of the front portion is equal to or less than 174 ".

10. In a head covering having a continuous frame extending about the covering, an improved size adjustment means for use with fixed size frames of various widths, said means being adjustable to provide an inner diameter of variable size comprising:

a pair of reversible guide means secured to the inner surface of said frame on opposite sides thereof, each of said guide means having at least one headed stud protruding inwardly and positioned at a distance from the lower edge of the guide means which is greater than the distance of the stud from the upper edge of the guide means;

an adjustable sweatband having a pair of slots, each slot for engagement with a respective one of said pair of guide means, said slots snapping over said studs for slidably suspending the sweatband therefrom, said sweatband having opposite ends; and means for connecting the opposite ends of said sweatband to form a continuous band around the inner surface of the frame, said connecting means being adjustable to provide an inner diameter of variable size.

11. The head covering of claim 10 with a frame having either a first width or a second width, said second width being greater than said first width, wherein said guide means are secured to a frame having said first width such that the upper edge of the guide means is aligned with the upper edge of said frame, said guide means being reversibly mounted and secured to a frame having said second width such that the lower edge of the guide is aligned with the upper edge of said frame.

12. In a head covering having a continuous frame extending about the covering, an improved size adjustment means for use with a fixed size frame, having upper and lower peripheral edges, said means being adjustable to provide an inner diameter of variable size comprising:

a pair of guide means secured to the inner surface of said frame on opposite sides thereof, each of said guide means having at least one headed stud protruding inwardly;

an adjustable sweatband having a pair of slots, each slot for engagement with a respective one of said pair of guide means, said slots snapping over said studs for slidably suspending the sweatband therefrom, said sweatband having opposite ends and upper and lower peripheral edges, the width of said sweatband gradually increasing from the slots toward the center of the sweatband, the lower edge of the sweatband from the opposite ends to the slots being aligned with the lower edge of the frame and the lower edge from each of the slots to the center of the sweatband extending below the lower edge of the frame when the sweatband is suspended; and means for connecting the opposite ends of said sweatband to form a continuous band around the inner surface of the frame, said connecting means being adjustable to provide an inner diameter of variable size.

13. The head covering of claim 12 wherein the maximum increase in width is equal to or less than $\frac{1}{4}$".

* * * * *